US010119296B2

(12) United States Patent
Deal

(10) Patent No.: US 10,119,296 B2
(45) Date of Patent: Nov. 6, 2018

(54) COLLAPSIBLE VEHICLE COVER

(71) Applicant: Harry Deal, Rock Hall, MD (US)

(72) Inventor: Harry Deal, Rock Hall, MD (US)

(73) Assignee: Harry Deal, Vero Beach, FL (US)

( * ) Notice: Subject to any disclaimer, the term of this patent is extended or adjusted under 35 U.S.C. 154(b) by 0 days.

(21) Appl. No.: 14/978,978

(22) Filed: Dec. 22, 2015

(65) Prior Publication Data

US 2016/0176277 A1 Jun. 23, 2016

Related U.S. Application Data

(60) Provisional application No. 62/095,496, filed on Dec. 22, 2014.

(51) Int. Cl.

| | |
|---|---|
| ***E04H 15/38*** | (2006.01) |
| ***E04H 15/02*** | (2006.01) |
| ***E04H 6/04*** | (2006.01) |

(52) U.S. Cl.

CPC ..... *E04H 15/38* (2013.01); *E04H 6/04* (2013.01); *E04H 15/02* (2013.01)

(58) Field of Classification Search

CPC ..... E04H 15/02; E04H 15/06; E04H 15/36; E04H 15/38; E04H 15/48; E04H 15/642; E04H 15/644; E04H 6/02; E04H 6/04

See application file for complete search history.

(56) References Cited

U.S. PATENT DOCUMENTS

| | | | | |
|---|---|---|---|---|
| 2,798,501 A * | 7/1957 | Oliver | B60J 11/00 | 135/134 |
| 2,856,942 A * | 10/1958 | Scott | E04H 6/04 | 135/117 |
| 3,036,583 A * | 5/1962 | Miller | B60J 11/00 | 135/116 |
| 3,540,458 A * | 11/1970 | Featheringill | E04H 15/48 | 135/117 |
| 3,712,316 A * | 1/1973 | Leonard | B60P 3/38 | 135/116 |

(Continued)

FOREIGN PATENT DOCUMENTS

| | | | |
|---|---|---|---|
| CA | 1129754 A * | 8/1982 | E04H 15/38 |
| FR | 2380155 A1 * | 9/1978 | B60J 11/00 |

(Continued)

*Primary Examiner* — David R Dunn
*Assistant Examiner* — Danielle Jackson
(74) *Attorney, Agent, or Firm* — Harry Deal

(57) ABSTRACT

A collapsible vehicle cover, which is positioned in a parking spot, garage or carport, is a retractable cover to protect a vehicle from the elements. The collapsible vehicle cover includes a front member, a rear member, a first hinged leg, a second hinged leg, a plurality of cross supports, a pair of cross support straps and a cover sheet. The front member, the rear member, the first hinged leg and the second hinged leg delineate a base supporting a framework of the plurality of cross supports and the pair of cross support straps. The cover sheet is fixed to the front member and the rear member while being supported by the plurality of cross supports and the pair of cross support straps. The cover sheet protects the vehicle from precipitation, ultraviolet (UV) radiation, and other hazards when the collapsible vehicle cover is configured into an expanded configuration around a vehicle.

19 Claims, 7 Drawing Sheets

(56) References Cited

U.S. PATENT DOCUMENTS 3,865,123 A * 2/1975 Bracken ..... E04H 15/38 135/132
4,058,133 A * 11/1977 Barr ..... B60P 3/38 135/132
4,271,856 A * 6/1981 Ferguson ..... B60P 3/38 135/132
4,886,083 A * 12/1989 Gamache ..... E04H 6/005 135/133
4,944,321 A * 7/1990 Moyet-Ortiz ..... B60J 11/00 135/148
5,740,826 A * 4/1998 Nevin ..... E04H 15/38 135/133
6,035,875 A * 3/2000 Chen ..... E04H 15/06 135/88.05
7,475,700 B2 * 1/2009 Pollard ..... E04H 15/38 135/132
8,171,947 B2 * 5/2012 Hardie ..... E04H 6/04 135/129
8,267,106 B2 * 9/2012 Jordache ..... E04H 6/04 135/129
8,714,174 B1 * 5/2014 DeSousa ..... E04H 15/58 135/117
8,967,172 B2 * 3/2015 Ying ..... E04H 6/04 135/129
8,978,679 B2 * 3/2015 Jennings ..... E04H 6/04 135/130
9,482,025 B2 * 11/2016 Ludlow ..... E04H 15/48
9,580,928 B1 * 2/2017 Currid ..... E04H 15/644
2005/0155299 A1 * 7/2005 Alspaugh ..... E04H 15/38 52/79.1
2006/0054208 A1 * 3/2006 Romano ..... E04H 15/38 135/132
2010/0126546 A1 * 5/2010 Chen ..... E04H 15/38 135/126
2010/0263698 A1 * 10/2010 Chiu ..... E04H 15/06 135/88.17
2013/0233365 A1 * 9/2013 Loos ..... E04H 15/005 135/114
2015/0368926 A1 * 12/2015 Herrera ..... E04H 6/04 135/133
2017/0073994 A1 * 3/2017 Allen ..... E04H 15/48

FOREIGN PATENT DOCUMENTS

FR 2614058 A1 * 10/1988 ..... E04H 15/38
FR 2695158 A1 * 3/1994 ..... E04H 6/04
FR 2702238 A1 * 9/1994 ..... E04H 15/38
GB 862011 A * 3/1961 ..... E04H 15/38

* cited by examiner

COLLAPSIBLE VEHICLE COVER

The current application claims a priority to the U.S. Provisional Patent application Ser. No. 62/095,496 filed on Dec. 22, 2014.

FIELD OF THE INVENTION

The present invention relates generally to vehicle covers. More specifically, the present invention relates to a collapsible cover with application for vehicles that include, but are not limited to, cars, motorcycles, and boats.

BACKGROUND OF THE INVENTION

Vehicle covers are common protective devices used by individuals to help maintain the condition of their motor vehicles for as long as possible. Whether an individual parks their vehicle in a parking lot, driveway, street, or garage, vehicle covers will help maintain the aesthetic of the vehicle for an extended period of time, as the vehicle is protected from the environment. As precipitation, falling debris, ultraviolet (UV) radiation or even people walking past the vehicle can possibly damage the finish of the vehicle, vehicle covers reduce the exposure of the vehicle to such harmful environmental effects. Even if a person is lucky enough to be able to park their car in a garage, these covers help prevent dust particles from settling on the cars exterior and wearing down its coat of paint.

Current vehicle covers are large, flimsy, and difficult to put on with only one person. A user can often take upwards of fifteen minutes to fully cover a vehicle and secure it properly, thus discouraging users from either removing the cover or deciding to continue using it on multiple occasions. Additionally, many covers do not fit right or come loose and then slide off due to various environmental effects.

It is therefore an objective of the present invention to introduce a collapsible vehicle cover that is lightweight, easy to assemble, and easy to use. The present invention is waterproof, breathable, provides UV protection, and shields the vehicle the present invention envelops from the harmful effects of the surrounding environment without physically touching the vehicle itself. Concerning cars, motorcycles, and similar vehicles, the cover is manufactured with dimensions so that the present invention fits within the legal size limits and parameters of standard parking spaces and may also be used on streets, garages, and more.

DETAIL DESCRIPTIONS OF THE INVENTION

All illustrations of the drawings are for the purpose of describing selected versions of the present invention and are not intended to limit the scope of the present invention.

The present invention is a collapsible vehicle cover. The present invention protects vehicles, such as cars, trucks, or motorcycles, from harmful effects of the surrounding environment without physically touching the vehicle itself. The present invention surrounds a vehicle to protect the exterior of the vehicle from precipitation, falling debris, ultraviolet (UV) radiation, or foot traffic which may be abrasive or corrosive to the exterior of the vehicle.

Figure 2:
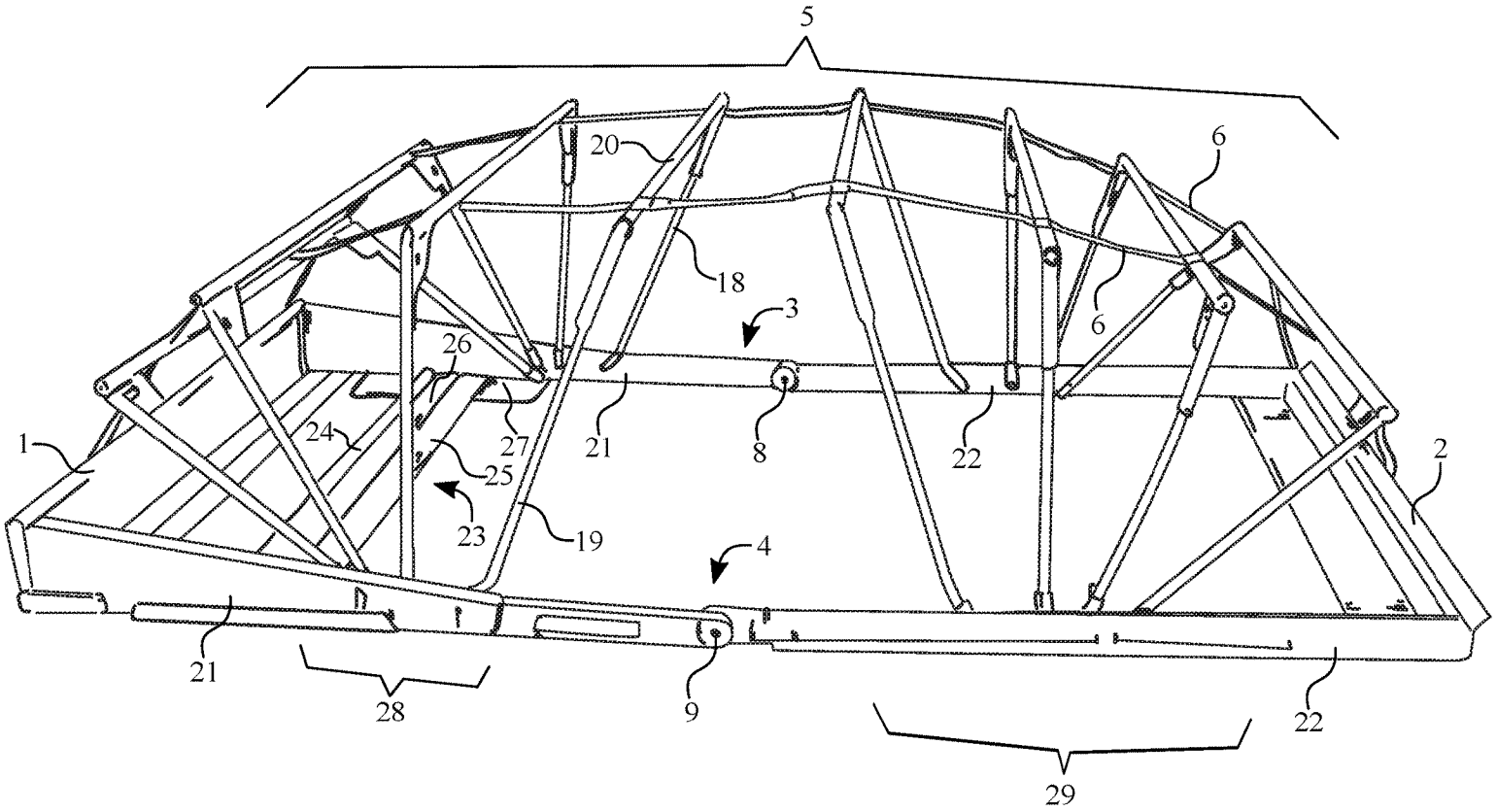
FIG. 2 is a side perspective view for the preferred embodiment of the present invention where the cover is removed.
Figure 5:
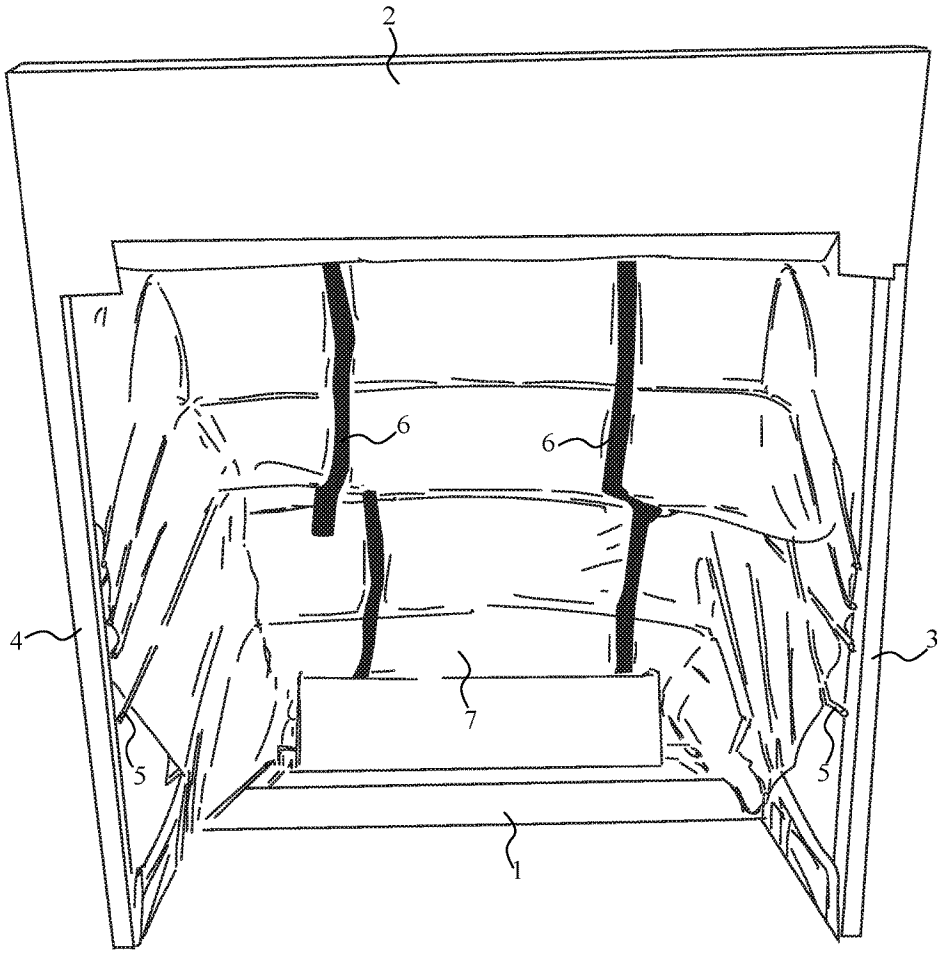
FIG. 5 is a rear view of the present invention transitioning between the extended and collapsed configurations.

In accordance to FIG. 5, the present invention comprises a front member 1, a rear member 2, a first hinged leg 3, a second hinged leg 4, a plurality of cross supports 5, a pair of cross support straps 6, and a cover sheet 7. The front member 1, the rear member 2, the first hinged leg 3, and the second hinged leg 4 provide a support base for the present invention, as shown in FIG. 2. The first hinged leg 3 and the second hinged leg 4 are perpendicularly and adjacently connected to the front member 1. The first hinged leg 3 and the second hinged leg 4 are positioned opposite to each other along the front member 1. Similarly, the first hinged leg 3 and the second hinged leg 4 are connected perpendicular and adjacent to the rear member 2, opposite the front member 1. The first hinged leg 3 and the second hinged leg 4 are positioned opposite to each other along the rear member 2. Thus, this configuration allows for a generally rectangular base for the present invention. The generally rectangular shape allows the present invention to fit into garages, carports, or standard parking spaces. The plurality of cross supports 5 and the pair of cross support straps 6 support the cover sheet 7 while the cover sheet 7 protects the vehicle from the elements. The pair of cross support straps 6 is perpendicularly connected from the front member 1, across each of the plurality of cross supports 5, and to the rear member 2, such that the plurality of cross supports 5 support the cover sheet 7 across a width of the cover sheet 7 while the pair of cross support straps 6 support the cover sheet 7 along the length of the cover sheet 7. The cover sheet 7 is attached from the front member 1, across each of the plurality of cross supports 5, along the pair of cross support straps 6 and to the rear member 2 in order to form an enclosure when the first hinged leg 3 and the second hinged leg 4 are configured in an expanded configuration for covering a vehicle. The plurality of cross supports 5 is rotatably fastened between the first hinged leg 3 and the second hinged leg 4 in order to provide a framework for the cover sheet 7 to be supported when the invention is in an expanded configuration.

Figure 1:
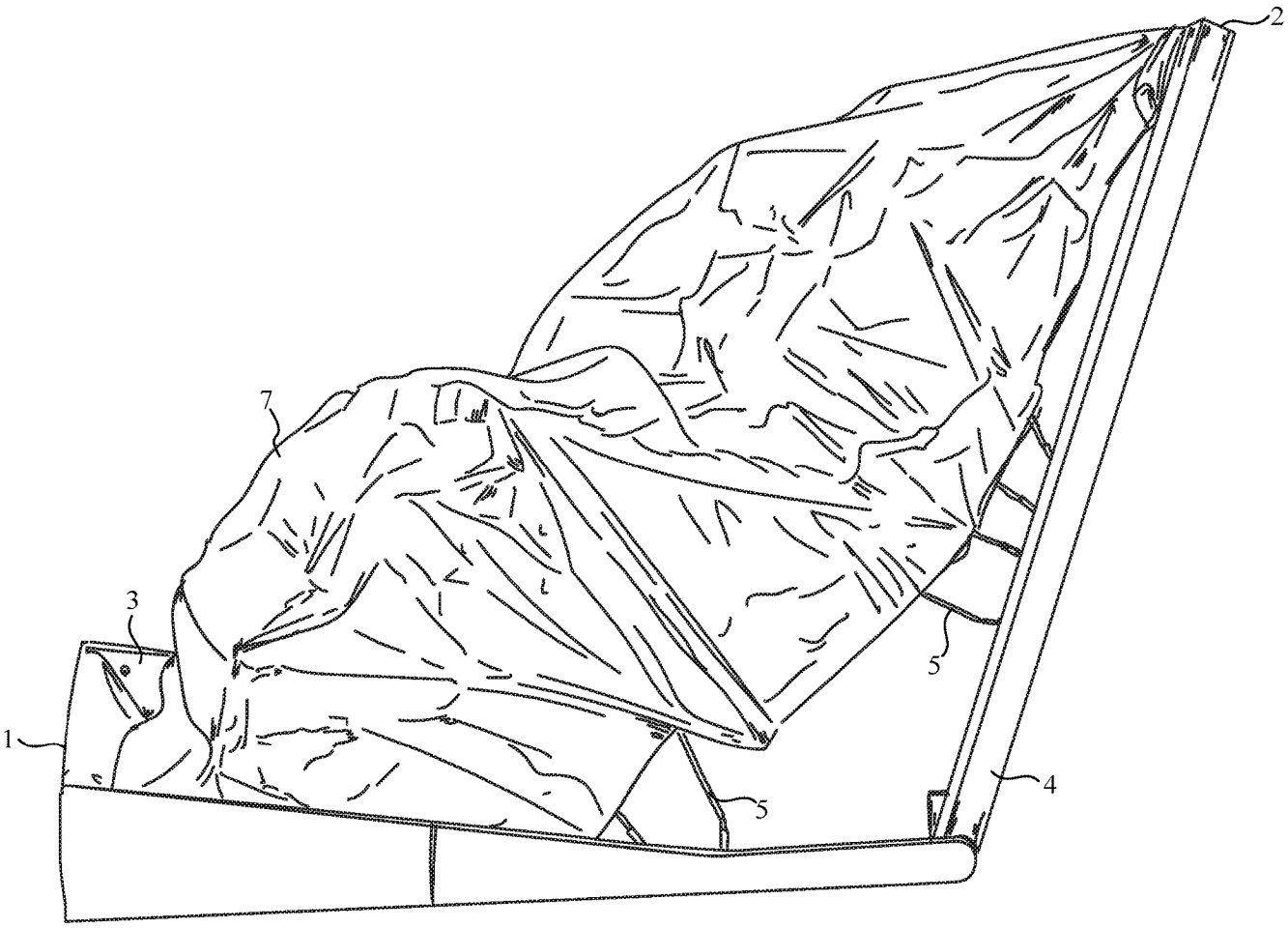
FIG. 1 is a side view of the present invention transitioning between an extended configuration and a collapsed configuration.
Figure 3:
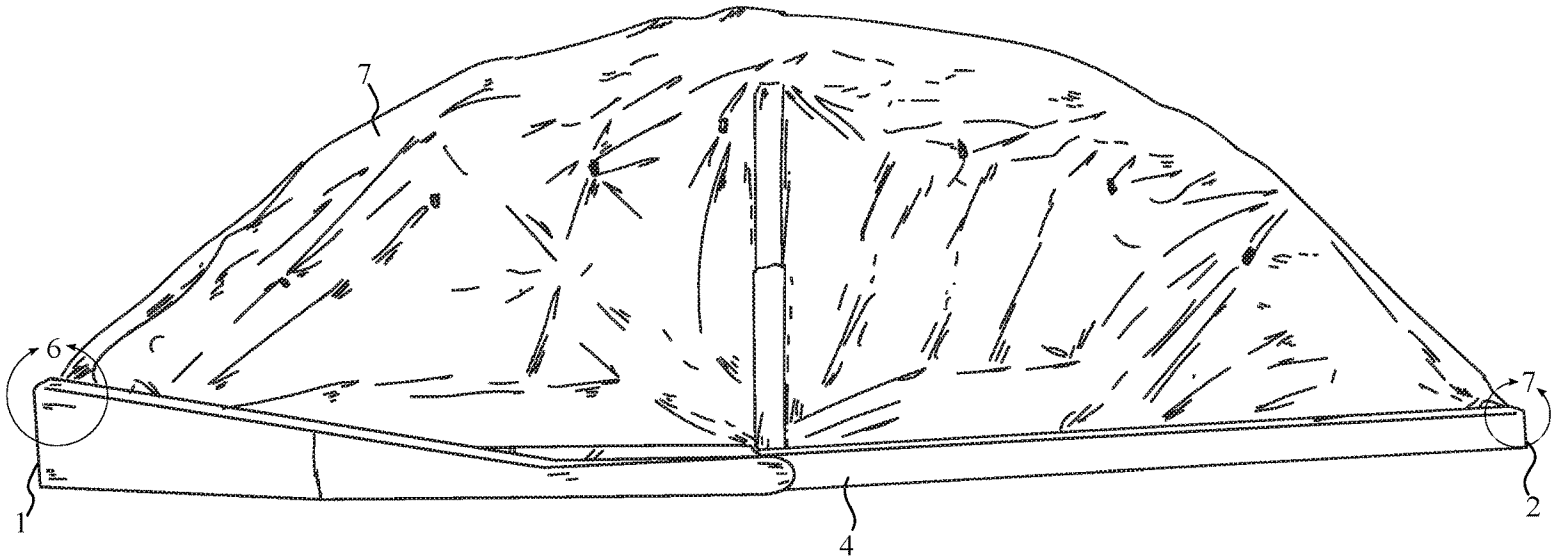
FIG. 3 is a side view of the present invention in the extended configuration.
Figure 4:
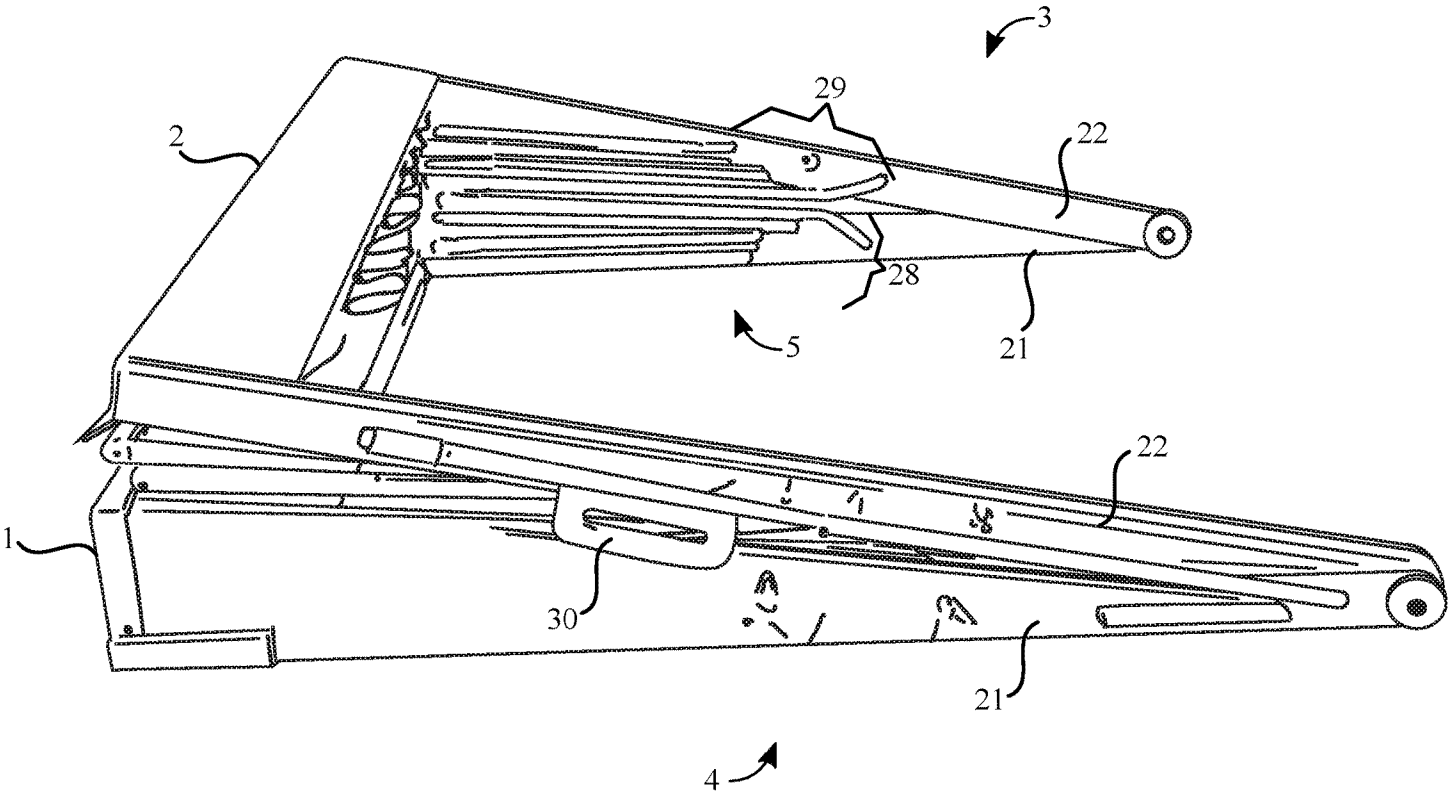
FIG. 4 is a side perspective view of the present invention in the collapsed configuration.

The present invention is able to be configured into an expanded configuration for covering a vehicle, shown in FIG. 3, or a collapsed configuration, shown in FIG. 4. In the collapsed configuration, the vehicle can enter or exit the area which the front member 1, the rear member 2, the first hinged leg 3 and the second hinged leg 4 delineate as the base of the present invention. In order to allow for the present invention to transition between the collapsed configuration and the expanded configuration, the first hinged leg 3 comprises a first pivot point 8, and the second hinged leg 4 comprises a second pivot point 9, in accordance to FIG. 2. The first pivot point 8 is centrally positioned along the first hinged leg 3, and the second pivot point 9 is centrally positioned along the second hinged leg 4. The first pivot point 8 and the second pivot point 9 allow the rear member 2 to rotate about a mid-point for both the first hinged leg 3 and the second hinged leg 4. Thus, the present invention is able in the collapsed configuration to allow the vehicle to move in and out of the present invention provides or the present invention is in the expanded configuration to cover the vehicle. A transitional state of the present invention between the collapsed configuration and the expanded configuration is shown in FIG. 1.

In some embodiments of the present invention and FIG. 4, the present invention comprises a handle 30. The handle 30 allows the user to manipulate the present invention between the expanded configuration and the collapsed configuration. The handle 30 is connected to the second hinged leg 4 between the front member 1 and the rear member 2. The handle 30 is positioned adjacent to the plurality of cross supports 5 in order to allow the user enough leverage for rotating the rear member 2 towards the front member 1. In some embodiments of the handle 30, the handle 30 is retractable within the second hinged leg 4, wherein the user is able to position the handle 30 within into the second hinged leg 4 and lock the handle 30 in place to prevent unwanted tampering with the present invention or the vehicle positioned within the present invention.

Figure 6:
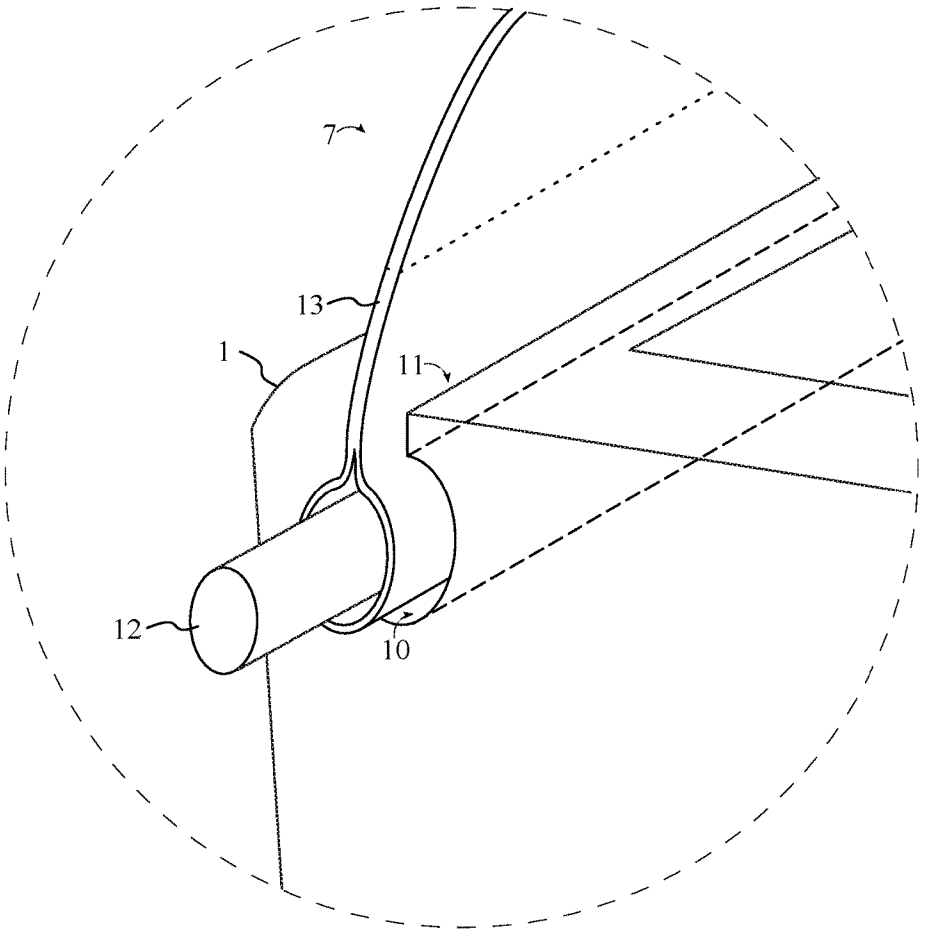
FIG. 6 is a detailed view of the connection between the cover sheet and the front member taken about circle 6 from FIG. 3.

In order to secure the cover sheet 7 to the present invention, the preferred embodiment of the present invention comprises a front tubular conduit 10 and a front slit 11. In accordance to FIG. 6, the cover sheet 7 engages the front tubular conduit 10 and the cover sheet 7 is restrained by the front slit 11. The front tubular conduit 10 and the front slit 11 traverses through and along the front member 1. The front slit 11 traverses through the front member 1 from the front tubular conduit 10. The cover sheet 7 comprises a front tubular shaft 12 and a first cover end 13. The first cover end 13 is connected along the front tubular shaft 12. The front tubular shaft 12 engages the front tubular conduit 10 such that the cover sheet 7 traverses through the front slit 11. Thus, as the cover sheet 7 is tautened as the present invention is configured into the expanded configuration, the front slit 11 prevents the front tubular shaft 12 from being pulled out of the front tubular conduit 10.

Figure 7:
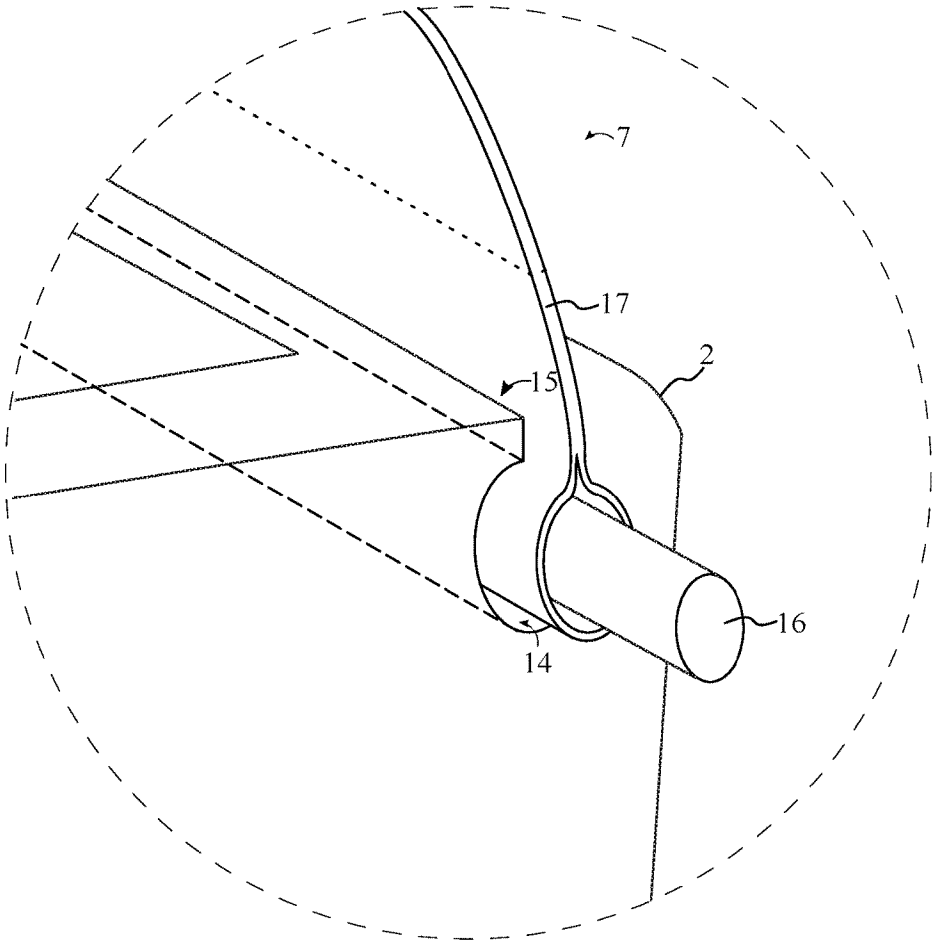
FIG. 7 is a detailed view of the connection between the cover sheet and the rear member taken about circle 7 from FIG. 3.

Similarly in accordance to the preferred embodiment of the present invention and FIG. 7, the present invention comprises a rear tubular conduit 14 and a rear slit 15. The cover sheet 7 engages the rear tubular conduit 14 and the cover sheet 7 is restrained by the rear slit 15. The rear tubular conduit 14 and the rear slit 15 traverses through and along the rear member 2. The rear slit 15 traverses through the rear member 2 from the rear tubular conduit 14. The cover sheet 7 comprises a rear tubular shaft 16 and a rear cover end 17. The rear cover end 13 is connected along the rear tubular shaft 16. The rear tubular shaft 16 engages the rear tubular conduit 17 such that the cover sheet 7 traverses through the rear slit 15. Thus, as the cover sheet 7 is tautened as the present invention is configured into the expanded configuration, the rear slit 15 prevents the rear tubular shaft 16 from being pulled out of the rear tubular conduit 14.

In accordance to the preferred embodiment of the present invention and FIG. 2, each of the plurality of cross supports 5 comprises a first cross support leg 18, a second cross support leg 19 and a cross support member 20. The first cross support leg 18 and the second cross support leg 19 are perpendicularly and adjacently connected to the cross support member 20. The first cross support leg 18 and the second cross support leg 19 are positioned opposite to each other along the cross support member 20. This configuration allows for the support of the cover sheet 7 in the expanded configuration and delineating the enclosure volume of the present invention which the vehicle occupies. The first cross support leg 18 is rotatably connected to the first hinged leg 3, while the second cross support leg 19 is rotatably connected to the second hinged leg 4. This allows for the plurality of cross supports 5 to collapse onto each other as the rear member 2 is rotated onto the front member 1 into the collapsed configuration.

In accordance to the preferred embodiment, the first cross support leg 18 and the second cross support leg 19 are bent at a midpoint toward each other. In conjunction with the curvature of the cover sheet 7 in the expanded configuration, precipitation or falling debris is directed away from the center of the cover sheet 7 in order to prevent an accumulation of precipitation or debris on the cover sheet 7. In some embodiments of the present invention, the first cross support leg 18 and the second cross support leg 19 traverse through a portion of the cover sheet 7 in order to reinforce the cover sheet 7 from lateral pressure forces. Further, some embodiments of the present invention comprise a pair of vertical supports to further reinforce the cover sheet 7 from lateral pressure forces. The pair of vertical supports is integrated into the cover sheet 7 and attaches to the first hinged leg 3 and the second hinged leg 4, adjacent to the first pivot point 8 and the second pivot point 9, respectively.

Further in accordance to the preferred embodiment, the first hinged leg 3 and the second hinged leg 4 are modular. As such, the first hinged leg 3 and the second hinged leg 4 each comprise a front leg portion 21 and a rear leg portion 22. The front leg portion 21 is adjacently connected to the front member 1. Similarly, the rear leg portion 22 is connected to the rear member 2. The front leg portion 21 is pivotally connected to the rear leg portion 22 opposite to the front member 1 for each the first hinged leg 3 and the second hinged leg 4. The front leg portion 21 is preferred to connect to the rear leg portion 22 though a pinned connection such that the front leg portion 21 and the rear leg portion 22 are able to rotate about the pivotal connection.

Further in accordance to this embodiment of the present invention, the plurality of cross supports 5 comprises a front plurality of cross supports 28 and a rear plurality of cross supports 29. The front plurality of cross supports 28 is rotatably connected to the front leg portion 21 of the first hinged leg 3 and the front leg portion 21 of the second hinged leg 4. Similarly, the rear plurality of cross supports 29 is rotatably connected to the rear leg portion 22 of the first hinged leg 3 and the rear leg portion 22 of the second hinged leg 4. Thus, this configuration further distributes support of the cover sheet 7 on the plurality of cross supports 5 along the length of the cover sheet 7. This configuration allows the front plurality of cross supports 28 to independently move from the rear plurality of cross supports 29 as the rear leg portion 22 moves toward or away from the front leg portion 21 while transitioning between the expanded and collapsed configuration of the present invention.

In some embodiments of the present invention, the present invention comprises a tire support 23, show in FIG. 2. The tire support 23 is positioned along the first hinged leg 3 and the second hinged leg 4 where a vehicle's tires would be positioned in implementation of the present invention. The tire support 23 allows a driver to know how far to position the car into the area which the present invention encompasses as well as an additional weight to secure the present invention from wind or other unintended lateral forces. The tire support 23 comprises a first raised edge 24, a second raised edge 25, a tire alignment plate 26, and a position adjusting mechanism 27. The first raised edge 24 and the second raised edge 25 provide a noticeable elevation difference as a vehicle's tire engages each. The tire alignment plate 26 positions the tires of a vehicle within the present invention during implementation. The first raised edge 24 is positioned opposite to the second raised edge 25 across the tire alignment plate 26. The tire alignment plate 26 is positioned between the first hinged leg 3 and the second hinged leg 4. The tire alignment plate 26 is mounted along the first hinged leg 3 and the second hinged leg 4 by the position adjusting mechanism 27. The position adjusting mechanism 27 allows the user to position the tire alignment plate 26 to fit their vehicle's length such that the present invention is able to enclose the vehicle. The position adjusting mechanism 27 is preferred to be a series of apertures which the tire alignment plate 26 is aligned to the user's preference and fastened to the first hinged leg 3 and the second hinged leg 4.

As previously mentioned, the present invention is able to be configured in a collapsed configuration for positioning a vehicle within the present invention before implementation or removing a vehicle from the present invention, in accordance to FIG. 4. In order to configure the present invention into the collapsed configuration, the user positions the rear member 2 adjacent to the front member 1 by rotating the rear member 2 simultaneously about both the first pivot point 8 and the second pivot point 9. As the rear member 2 is rotated to the front member 1, the front plurality of cross supports 28 are positioned parallel to the rear plurality of cross supports 29. The rear leg portion 22 of the first hinged leg 3 is positioned adjacent to the front leg portion 21 of the first hinged leg 3. Similarly, the rear leg portion 22 of the second hinged leg 4 is positioned adjacent to the front leg portion 21 of the second hinged leg 4. Thus, the driver is able to drive their vehicle between the first hinged leg 3 and the second hinged leg 4 and onto the tire support 23 such that the present invention is ready to be configured into the expanded configuration.

For the expanded configuration, the rear leg portion 22 of the first hinged leg 3 is positioned collinear to the front leg portion 21 of the first hinged leg 3. Likewise, the rear leg portion 22 of the second hinged leg 4 is positioned collinear to the front leg portion 21 of the second hinged leg 4. Each of the front plurality of cross supports 28 extends away from the front leg portion 21 of the first hinged leg 3 and the front leg portion 21 of the second hinged leg 4. Similarly, each of the rear plurality of cross supports 29 extends away from the rear leg portion 22 of the first hinged leg 3 and the rear leg portion 22 of the second hinged leg 4. The pair of cross support straps 6 is taut on the plurality of cross supports 5 between the front member 1 and the rear member 2. The cover sheet 7 is taut from the front member 1, over the plurality of cross supports 5 on the pair of cross support straps 6, and to the rear member 2. Thus, the front member 1, the rear member 2, the first hinged leg 3, the second hinged leg 4, and the cover sheet 7 define an enclosed volume large enough for a vehicle to be housed within, in order to protect the vehicle from the elements.

The preferred method of forming the front member 1, the rear member 2, the first hinged leg 3 and the second hinged leg 4 is through a blow molding process; however, blow molding processes tend to leave these members as hollow supports. In such embodiments of the present invention, the present invention comprises at least one internal access port. An access aperture of the at least one internal access port traverses through each the front member 1, the rear member 2, the first hinged leg 3, and the second hinged leg 4. Through the access aperture, a weight source can be inserted to weigh down the present invention such as sand, water, or another applicable weight source.

Alternatively, the present invention can be secured directly to the concrete or ground though a plurality of anchors. The plurality of anchors is integrated through each of the front member 1, the rear member 2, the first hinged leg 3 and the second hinged leg 4. A corresponding anchor receiver is embedded into the ground for each of the plurality of anchors. Each of the plurality of anchors engages the corresponding anchor receiver in order to mount the present invention onto the ground.

Although the invention has been explained in relation to its preferred embodiment, it is to be understood that many other possible modifications and variations can be made without departing from the spirit and scope of the invention as hereinafter claimed.

What is claimed is:

1. A collapsible vehicle cover comprising:

a front member;

a rear member;

a first hinged leg;

a second hinged leg;

a plurality of cross supports;

a pair of cross support straps;

a cover sheet;

the first hinged leg and the second hinged leg being perpendicularly and adjacently connected to the front member;

the first hinged leg and the second hinged leg being positioned opposite to each other along the front member;

the first hinged leg and the second hinged leg being connected perpendicular and adjacent to the rear member, opposite the front member;

the first hinged leg and the second hinged leg being positioned opposite to each other along the rear member;

the plurality of cross supports being rotatably fastened between the first hinged leg and the second hinged leg;

the pair of cross support straps being perpendicularly connected from the front member, across each of the plurality of cross supports, and to the rear member;

the cover sheet being attached from the front member, across each of the plurality of cross supports, along the pair of cross support straps, and to the rear member;

the front member, the rear member, the first hinged leg and the second hinged leg each being formed by a blow molding process;

the front member, the rear member, the first hinged leg and the second hinged leg each comprising an internal hollow, an access aperture and a weight source;

the internal hollow and the access aperture being communicated with each other; and the weight source being accommodated within the internal hollow through the access aperture.

2. The collapsible vehicle cover as claimed in claim 1 comprising:

the first hinged leg comprising a first pivot point;

the second hinged leg comprising a second pivot point;

the first pivot point being centrally positioned along the first hinged leg; and the second pivot point being centrally positioned along the second hinged leg.

3. The collapsible vehicle cover as claimed in claim 1 comprising:

a front tubular conduit;
a front slit;
the cover sheet comprising a front tubular shaft and a first cover end;
the front tubular conduit and the front slit traversing through and along the front member;
the front slit traversing through the front member from the front tubular conduit;
the first cover end being connected along the front tubular shaft;
the front tubular shaft engaging the front tubular conduit; and
the cover sheet traversing through the front slit.

4. The collapsible vehicle cover as claimed in claim 1 comprising:
a rear tubular conduit;
a rear slit;
the cover sheet comprising a rear tubular shaft and a second cover end;
the rear tubular conduit and the rear slit traversing through and along the rear member;
the rear slit traversing through the rear member from the rear tubular conduit;
the second cover end being connected along the rear tubular shaft;
the rear tubular shaft engaging the rear tubular conduit; and
the cover sheet traversing through the rear slit.

5. The collapsible vehicle cover as claimed in claim 1 comprising:
each of the plurality of cross supports comprising a first cross support leg, a second cross support leg, and a cross support member;
the first cross support leg and the second cross support leg being perpendicularly and adjacently connected to the cross support member;
the first cross support leg and the second cross support leg being positioned opposite to each other along the cross support member;
the first cross support leg being rotatably connected to the first hinged leg; and
the second cross support leg being rotatably connected to the second hinged leg.

6. The collapsible vehicle cover as claimed in claim 1 comprising:
the first hinged leg and the second hinged leg each comprise a front leg portion and a rear leg portion;
the plurality of cross supports comprising a front plurality of cross supports and a rear plurality of cross supports;
the front leg portion being adjacently connected to the front member;
the rear leg portion being adjacently connected to the rear member;
the front leg portion being pivotally connected to the rear leg portion, opposite the front member;
the front plurality of cross supports being rotatably connected to the front leg portion of the first hinged leg and the front leg portion of the second hinged leg; and
the rear plurality of cross supports being rotatably mounted to the rear leg portion of the first hinged leg and the rear leg portion of the second hinged leg.

7. The collapsible vehicle cover as claimed in claim 6 comprising:
the collapsible vehicle cover being in a collapsed configuration;
the rear member being positioned adjacent to the front member;
the front plurality of cross supports being positioned parallel to the rear plurality of cross supports;
the rear leg portion of the first hinged leg being positioned adjacent to the front leg portion of the first hinged leg;
the rear leg portion of the second hinged leg being positioned adjacent to the front leg portion of the second hinged leg; and
the front member, the rear member, the first hinged leg and the second hinged leg being capable of preventing the plurality of cross supports, the pair of cross support straps and the cover sheet from contacting a ground when the collapsible vehicle cover is in the collapsed configuration.

8. The collapsible vehicle cover as claimed in claim 6 comprising:
the collapsible vehicle cover being in an expanded configuration;
the rear leg portion of the first hinged leg being positioned collinear to the front leg portion of the first hinged leg;
the rear leg portion of the second hinged leg being positioned collinear to the front leg portion of the second hinged leg;
each of the front plurality of cross supports extending away from the front leg portion of the first hinged leg and the front leg portion of the second hinged leg;
each of the rear plurality of cross supports extending away from the rear leg portion of the first hinged leg and the rear leg portion of the second hinged leg;
the pair of cross support straps being taut on the plurality of cross supports between the front member and the rear member;
the cover sheet being taut from the front member, over the plurality of cross supports on the pair of cross support straps, and to the rear member; and
the front member, the rear member, the first hinged leg and the second hinged leg being capable of preventing the plurality of cross supports, the pair of cross support straps and the cover sheet from contacting a ground when the collapsible vehicle cover is in the expanded configuration.

9. The collapsible vehicle cover as claimed in claim 1 comprising:
a tire support;
the tire support comprising a first raised edge, a second raised edge, a tire alignment plate, and a position adjusting mechanism;
the first raised edge being positioned opposite to the second raised edge across the tire alignment plate;
the tire alignment plate being positioned between the first hinged leg and the second hinged leg; and
the tire alignment plate being mounted along the first hinged leg and the second hinged leg by the position adjusting mechanism.

10. The collapsible vehicle cover as claimed in claim 1 comprising:
a handle;
the handle being connected to the second hinged leg, between the front member and the rear member; and
the handle being positioned adjacent to the plurality of cross supports.

11. A collapsible vehicle cover comprising:
a front member;
a rear member;
a first hinged leg;
a second hinged leg;
a plurality of cross supports;
a pair of cross support straps;

a cover sheet;

the first hinged leg comprising a first pivot point;

the second hinged leg comprising a second pivot point;

the first hinged leg and the second hinged leg being perpendicularly and adjacently connected to the front member;

the first hinged leg and the second hinged leg being positioned opposite to each other along the front member;

the first hinged leg and the second hinged leg being connected perpendicular and adjacent to the rear member, opposite the front member;

the first hinged leg and the second hinged leg being positioned opposite to each other along the rear member;

the plurality of cross supports being rotatably fastened between the first hinged leg and the second hinged leg;

the pair of cross support straps being perpendicularly connected from the front member, across each of the plurality of cross supports, and to the rear member; and the cover sheet being attached from the front member, across each of the plurality of cross supports, along the pair of cross support straps, and to the rear member;

the first pivot point being centrally positioned along the first hinged leg;

the second pivot point being centrally positioned along the second hinged leg;

the front member, the rear member, the first hinged leg and the second hinged leg each being formed by a blow molding process;

the front member, the rear member, the first hinged leg and the second hinged leg each comprising an internal hollow, an access aperture and a weight source;

the internal hollow and the access aperture being communicated with each other; and the weight source being accommodated within the internal hollow through the access aperture.

12. The collapsible vehicle cover as claimed in claim 11 comprising:

a front tubular conduit;

a front slit;

the cover sheet comprising a front tubular shaft and a first cover end;

the front tubular conduit and the front slit traversing through and along the front member;

the front slit traversing through the front member from the front tubular conduit;

the first cover end being connected along the front tubular shaft;

the front tubular shaft engaging the front tubular conduit; and the cover sheet traversing through the front slit.

13. The collapsible vehicle cover as claimed in claim 11 comprising:

a rear tubular conduit;

a rear slit;

the cover sheet comprising a rear tubular shaft and a second cover end;

the rear tubular conduit and the rear slit traversing through and along the rear member;

the rear slit traversing through the rear member from the rear tubular conduit;

the second cover end being connected along the rear tubular shaft;

the rear tubular shaft engaging the rear tubular conduit; and the cover sheet traversing through the rear slit.

14. The collapsible vehicle cover as claimed in claim 11 comprising:

each of the plurality of cross supports comprising a first cross support leg, a second cross support leg, and a cross support member;

the first cross support leg and the second cross support leg being perpendicularly and adjacently connected to the cross support member;

the first cross support leg and the second cross support leg being positioned opposite to each other along the cross support member;

the first cross support leg being rotatably connected to the first hinged leg; and the second cross support leg being rotatably connected to the second hinged leg.

15. The collapsible vehicle cover as claimed in claim 11 comprising:

the first hinged leg and the second hinged leg each comprise a front leg portion and a rear leg portion;

the plurality of cross supports comprising a front plurality of cross supports and a rear plurality of cross supports;

the front leg portion being adjacently connected to the front member;

the rear leg portion being adjacently connected to the rear member;

the front leg portion being pivotally connected to the rear leg portion, opposite the front member;

the front plurality of cross supports being rotatably connected to the front leg portion of the first hinged leg and the front leg portion of the second hinged leg; and the rear plurality of cross supports being rotatably mounted to the rear leg portion of the first hinged leg and the rear leg portion of the second hinged leg.

16. The collapsible vehicle cover as claimed in claim 15 comprising:

the collapsible vehicle cover being in a collapsed configuration;

the rear member being positioned adjacent to the front member;

the front plurality of cross supports being positioned parallel to the rear plurality of cross supports;

the rear leg portion of the first hinged leg being positioned adjacent to the front leg portion of the first hinged leg;

the rear leg portion of the second hinged leg being positioned adjacent to the front leg portion of the second hinged leg; and the front member, the rear member, the first hinged leg and the second hinged leg being capable of preventing the plurality of cross supports, the pair of cross support straps and the cover sheet from contacting a ground when the collapsible vehicle cover is in the collapsed configuration.

17. The collapsible vehicle cover as claimed in claim 15 comprising:

the collapsible vehicle cover being in an expanded configuration;

the rear leg portion of the first hinged leg being positioned collinear to the front leg portion of the first hinged leg;

the rear leg portion of the second hinged leg being positioned collinear to the front leg portion of the second hinged leg;

each of the front plurality of cross supports extending away from the front leg portion of the first hinged leg and the front leg portion of the second hinged leg;

each of the rear plurality of cross supports extending away from the rear leg portion of the first hinged leg and the rear leg portion of the second hinged leg;

the pair of cross support straps being taut on the plurality of cross supports between the front member and the rear member;

the cover sheet being taut from the front member, over the plurality of cross supports on the pair of cross support straps, and to the rear member; and the front member, the rear member, the first hinged leg and the second hinged leg being capable of preventing the plurality of cross supports, the pair of cross support straps and the cover sheet from contacting a ground when the collapsible vehicle cover is in the expanded configuration.

18. The collapsible vehicle cover as claimed in claim 11 comprising:

a tire support;

the tire support comprising a first raised edge, a second raised edge, a tire alignment plate, and a position adjusting mechanism;

the first raised edge being positioned opposite to the second raised edge across the tire alignment plate;

the tire alignment plate being positioned between the first hinged leg and the second hinged leg; and the tire alignment plate being mounted along the first hinged leg and the second hinged leg by the position adjusting mechanism.

19. The collapsible vehicle cover as claimed in claim 11 comprising:

a handle;

the handle being connected to the second hinged leg, between the front member and the rear member; and the handle being positioned adjacent to the plurality of cross supports.

* * * * *